United States Patent [19]

Arakawa

[11] 3,945,771

[45] Mar. 23, 1976

[54] SUBMERGED PUMP

[75] Inventor: Shinichiro Arakawa, Fujisawa, Japan

[73] Assignee: Ebara Manufacturing Co., Ltd., Tokyo, Japan

[22] Filed: Oct. 1, 1974

[21] Appl. No.: 511,468

[30] Foreign Application Priority Data

Oct. 16, 1973 Japan ..... 48-119417[U]

[52] U.S. Cl. ..... 417/424; 415/211; 415/219 C

[51] Int. Cl.[2] F04B 17/00; F04D 29/44; F04D 29/54

[58] Field of Search ..... 417/424, 366; 415/211, 415/219 C, 186, 205, 206

[56] References Cited

UNITED STATES PATENTS

| | | | |
|---|---|---|---|
| 1,004,212 | 9/1911 | Smith | 415/206 |
| 2,612,843 | 10/1952 | Gruetjen | 415/207 |
| 2,625,110 | 1/1953 | Haentjens et al. | 417/424 |

*Primary Examiner*—C. J. Husar
*Assistant Examiner*—Thomas I. Ross
*Attorney, Agent, or Firm*—Wenderoth, Lind & Ponack

[57] ABSTRACT

In a submerged pump of a type having a pump casing in which a cylindrical motor casing is housed, the pump casing and the motor casing are constructed in such a way that the pump casing is given the shape of a polygonal column and the motor casing substantially inscribes the inner surface of the respective walls of the pump casing. The space defined by the adjacent inscribing lines and the portions of the walls between the lincs is adapted to pass water without creating spiral flow therethrough from a discharge port of the volute chamber toward the discharge opening of the pump.

4 Claims, 5 Drawing Figures

SUBMERGED PUMP

FIELD OF INVENTION

This invention relates to a submerged pump and, more specifically, to the improvement in the submerged pump having a pump casing around a motor casing.

BACKGROUND OF INVENTION

In a submerged pump of the prior art which is provided with a pump casing outside of the motor for driving the pump, it has been generally known to form the pump casing in a cylindrical configuration so as to provide a substantially uniform gap between the casing and the motor. Consequently, water drawn from a suction port of the pump and passed through volutes of the pump is advanced toward a discharge opening through the gap wherein the flow of water follows a spiral path. Further, at least two volutes are normally provided in a volute casing of the pump so as to balance radial thrust. Thus, each water flow discharged from an outlet of the respective volute will interfere with other flow during the passage of the gap where the respective flow takes the spiral path.

The spiral passage causes the water flow to stay longer in the gap and to increase the friction loss. Also, due to the interference between the water flows, several other losses will be derived thereby remarkably reducing the efficiency of the pump.

SUMMARY OF INVENTION

It is, therefore, an object of this invention to provide a submerged pump which is free of the drawbacks above.

It is another object of this invention to provide a submerged pump having high efficiency.

It is also an object of the invention to provide a submerged pump having a configuration which is also suitable for operating the pump in water.

According to the present invention, there is provided a submerged pump having a pump casing of polygonal shape. The pump casing surrounds the motor casing so as to provide a plurality of gaps between the pump casing and the motor casing, each of the gaps being separated from the other thereby eliminating the possibility of interference between the water flows discharged from the discharge side of the volute and restricting the flow so as to follow the spiral path.

The advantage and novel features of the invention will be apparent from the following detailed description of illustrative preferred embodiments referring to the accompanying drawings.

DESCRIPTION OF EMBODIMENT

Before explaining the embodiments of the invention, the pump of the prior art will be briefly touched upon.

Figure 1:
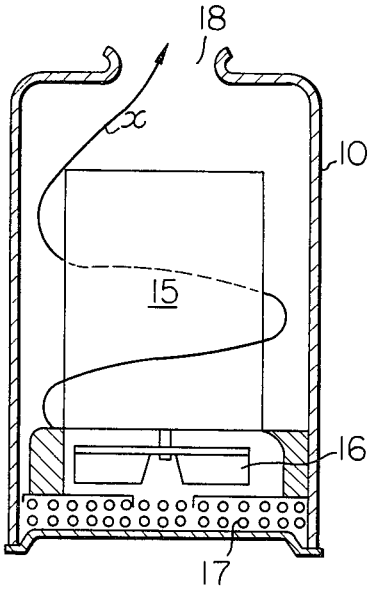
Fig. 1 (PRIOR ART)
FIG. 1 is a sectional side view of a submerged pump of prior art.
Figure 2:
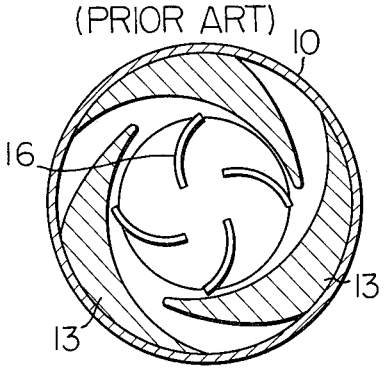
Fig. 2 (PRIOR ART)
FIG. 2 is a plan view of the pump shown in FIG. 1 sectioned normal to the longitudinal axis of the pump at a chamber containing an impeller.

There is shown, in FIGS. 1 and 2, an illustrative example of the submerged pump of the prior art. As illustrated in these figures, a pump casing 10 located outside of a motor casing 15 is cylindrical in form and there is a substantially uniform gap between the casings 10 and 15. When the pump is driven, water is drawn into the gap through an intake port 17 in the bottom of the pump and volutes 13. Upon flowing out of the discharge side of the volutes 13 into the gap, the water flow takes several turns around the motor casing 15 in a spiral as indicated by *x* in FIG. 1 and finally reaches a discharge port 18 provided at the upper portion of the pump. Since the number of volutes is at least two so as to balance the radial thrust in the pump, a plurality of water flows are discharged from the outlet side of the volutes 13 and, thus, each of the flows interferes with others in the course of its respective spiral path. As already discussed hereinbefore, the condition above creates several losses which result in decreased efficiency of the pump.

Figure 3:
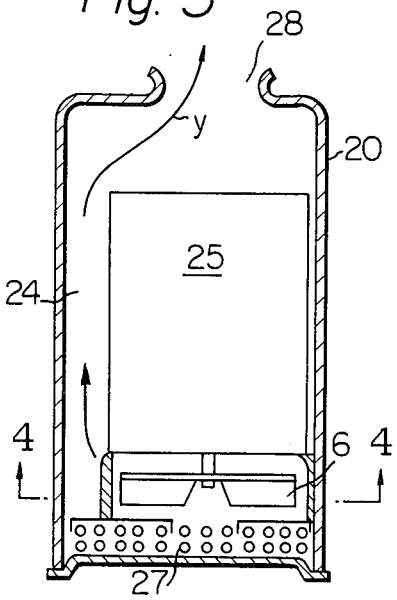
FIG. 3 is an embodiment according to the invention showing a sectional side view thereof.
Figure 4:
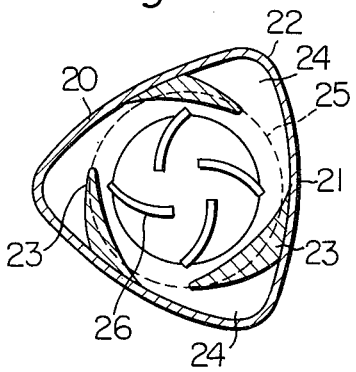
FIG. 4 is a sectional plan view taken along the line 4—4 of FIG. 3.

Now reference is made with respect to FIGS. 3 and 4 wherein a preferred embodiment of the invention is illustrated. As shown in FIG. 4 a pump casing 20 is formed to have shape of a polygonal column, as for example, a triangular column, the cross section of which is illustrated in FIG. 4. The portions around the ridge lines of the column where the adjoining surfaces of the polygonal column intersect with each other are preferably rounded as illustrated in FIG. 4. At the lower part of the casing 20, there is provided an intake opening 27 and a discharge opening 28 is provided at the upper portion of the casing 20.

Inside of the pump casing 20, a cylindrical motor casing 25 is disposed so as to substantially inscribe the inner surface of respective walls 21 constituting the polygonal pump casing 20. Below the motor casing, an impeller 26 is rotatably mounted so as to be driven by a motor contained in the motor casing 25.

Around the impeller, there are provided a plurality of volutes 23 in a manner similar to the prior pump. Since the embodiment illustrated in FIGS. 3 and 4 has the pump casing 20 of triangular column, the number of the volutes 23 is selected as three so that each of the discharge ports 24 formed by the volutes 23 is positioned at the respective apex of the triangle in the cross section. Around the portion of each wall 21, the thickness of each volute is relatively decreased so as to allow the substantial inscribing of the motor casing 25 by the pump casing 20.

According to the construction of the pump as explained above, water energized by the impeller 26 and discharged out the respective discharge port 24 is forced upwardly without receiving any interference from the water discharged from the other discharge ports 24 since each of the water flows is confined within the space defined by the two adjacent inscribing lines and the portions of walls disposed between the two lines above. Each of the water flows is, thus, guided upwardly within the space substantially in the direction indicated with *y* in FIG. 3 until it reaches the discharge opening 28. Accordingly, there will be no turbulence in the water flow within the pump casing 20 and the losses due to friction and interference of the water flows, which are relatively rapid, are remarkably reduced, thereby greatly increasing the efficiency of the pump. Further, since the pump casing 20 and the motor casing 25 substantially serve as guide vanes, it is not necessary in the device of the present invention to provide guide vanes which are normally required. In other words, even if a liquid passage exists in the portion where the motor casing 25 substantially inscribes the pump casing 20, there will be no substantial interference of the flows between the adjacent discharge ports 24.

In addition to the advantages and effect discussed above, the following point is to be appreciated. A submerged pump is generally used in the field of public works and, in such situations, if the configuration of the pump casing is a polygonal column, such as triangular column illustrated in FIGS. 3 and 4, the pump is stable and hard to tumble. This also provides the merit that the efficiency of the pump can be maintained for a fairly long period when the pump is put in continuous operation over an extended term.

Figure 5:
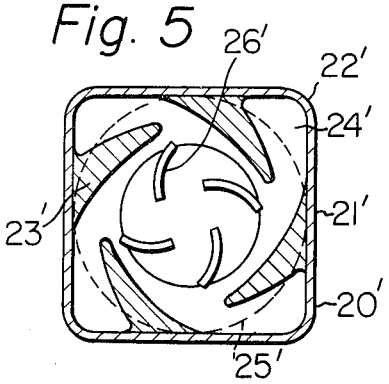
FIG. 5 is also a sectional plan view of another embodiment taken in a manner similar to FIG. 4.

As an alternative embodiment, one example is shown in FIG. 5 wherein the section of the pump casing 20' is a square. In this embodiment, the elements similar to those in FIGS. 3 and 4 are given similar references with prime added thereto respectively. In this case also, the volute discharge openings 24' are disposed, as viewed in the cross section, at the respective apexes or corners 22' of the square.

Although the invention has been explained with examples of pump casing constructed as a triangular column or a square column, any polygonal column may be employed as far as it is practically applicable.

It is noted, if the pump casing is made to be a triangular column as illustrated in FIGS. 3 and 4, the space defined between the pump casing 20 and the water casing 25 is such that the ratio of the cross sectional area of the space through which the water flow is guided to the area of the wall contacting the water flow becomes the maximum and accordingly the highest efficiency of the pump is likely obtained.

While the invention has been described in detail with particular reference to illustrative embodiments thereof, it will be understood that variations and modifications can be effected within the spirit and scope of the invention.

What is claimed is:

1. A submersible pump for pumping liquid comprising:

a polygonal pump casing column having an inlet at one axial end of the column and an outlet at the opposite end of the column;

a motor positioned at the inlet of said column and a rotary shaft fitted to and downward from said motor;

a cylindrical motor casing means for containing therein said motor and shaft, said casing means being fitted within said casing column with the casing means substantially inscribing each of the respective walls of the casing column and forming a plurality of columnar spaces substantially isolated from each other between the outer surface of the motor casing means and the inner surface of the pump casing column parallel to the axis of the cylindrical casing means;

an impeller mounted on said shaft near the inlet to said column; and a plurality of volutes within said pump casing column near said inlet port, beneath said motor casing and surrounding said impeller, forming a plurality of discharge passages from the inlet port discharging into the columnar spaces around the motor casing, the number of volutes and passages corresponding to the number of columnar spaces between the pump casing and the motor casing, whereby the liquid impelled through the inlet by the impeller discharges through said passages into the columnar spaces and is directed axially upward therethrough to the outlet.

2. A pump as claimed in claim 1, wherein the discharge passages from the inlet to the columnar spaces defined by the volutes discharge into the columnar spaces at the intersecting angles of the sides of the polygonal column.

3. A submerged pump as claimed in claim 1 wherein said polygonal column is a triangular prism.

4. A submerged pump as claimed in claim 1 wherein said polygonal column is a square in cross section.

* * * * *